US005862755A

United States Patent [19]

Haupenthal

[11] Patent Number: 5,862,755

[45] Date of Patent: Jan. 26, 1999

[54] ROTARY PRINTING-MACHINE CYLINDER HAVING A VARIABLE OUTER DIAMETER

[75] Inventor: Rudi Haupenthal, Epfenbach, Germany

[73] Assignee: Heidelberger Druckmaschinen Aktiengesellschaft, Heidelberg, Germany

[21] Appl. No.: 847,862

[22] Filed: Apr. 28, 1997

[30] Foreign Application Priority Data

Apr. 27, 1996 [DE] Germany ..... 196 17 021.4

[51] Int. Cl.[6] ..... B41F 21/00

[52] U.S. Cl. ..... 101/246; 101/216; 101/409; 271/277

[58] Field of Search ..... 101/408, 409, 101/410, 411, 412, 216, 230, 231, 232, 246, 174, 175, 375, 378, 401.1; 271/277, 82; 492/21, 22, 23, 24, 25, 26

[56] References Cited

U.S. PATENT DOCUMENTS

| | | | |
|---|---|---|---|
| 2,558,689 | 6/1951 | Miller | 492/21 |
| 3,602,140 | 8/1971 | Sudduth | 271/277 |
| 3,654,861 | 4/1972 | Rudolph et al. | 101/230 |
| 4,334,473 | 6/1982 | Becker et al. | 101/409 |
| 5,026,045 | 6/1991 | Wirz et al. | 271/277 |
| 5,480,138 | 1/1996 | Haupenthal et al. | 271/277 |
| 5,579,691 | 12/1996 | Voge | 101/246 |

FOREIGN PATENT DOCUMENTS

| | | | |
|---|---|---|---|
| 0 185 965 A2 | 7/1986 | European Pat. Off. . | |
| 0185965 | 7/1986 | European Pat. Off. | 101/409 |
| 44 34 828 | 11/1995 | Germany . | |
| 499 388 | 1/1971 | Switzerland . | |
| 1 230 314 | 4/1971 | United Kingdom . | |
| 2 166 388 | 5/1986 | United Kingdom . | |

*Primary Examiner*—Edgar Burr
*Assistant Examiner*—Amanda B. Sandusky
*Attorney, Agent, or Firm*—Herbert L. Lerner; Laurence A. Greenburg

[57] ABSTRACT

A cylinder of a rotary printing machine having an inner cylinder body includes an elastically deformable cylinder jacket formed as part of a circle, the cylinder jacket being substantially intrinsically rigid, and an adjusting device for acting upon the elastically deformable cylinder jacket so as to vary the outer diameter thereof, the adjusting device having a positioning part supported on and radially displaceable relative to the inner cylinder body for shifting the cylinder jacket jointly therewith in the same radial direction, and having a force deflector displaceable over a positioning travel distance derivable from the radial displacement of the cylinder jacket for acting upon the cylinder jacket so as to deform it.

20 Claims, 6 Drawing Sheets

ROTARY PRINTING-MACHINE CYLINDER HAVING A VARIABLE OUTER DIAMETER

BACKGROUND OF THE INVENTION

1. Field of the Invention

The invention relates to a cylinder, in particular, a rotary printing-machine sheet-guiding cylinder, having an outer diameter which, because the cylinder has an elastically deformable, partly circular cylinder jacket, is variable by an adjusting device.

In the instant application, the cylinder jacket has been described as being "partly circular". This does not mean that only mathematically exact partially circular contours are provided, but rather, that contours which are formed approximately as a partial circle or, in other words, have certain out-of-round features are also included.

A cylinder of the type referred to in the introduction hereto is disclosed in German Patent 44 34 828. The cylinder known from this prior art reference has an elastically deformable cylinder jacket, which is supported by rollers 4 resting on inclined faces of a positioning disk 5 which is rotatable relative to an inner cylinder base body. If a rotation is effected, the radial spacing of the rollers from the cylinder base body is changed and, as a result, the cylinder jacket is widened or, depending upon the relative direction of rotation, decreased in diameter. By such a diameter adjustment, it is possible to adapt to or match the thickness of the printing material or stock. In the heretofore known construction, the cylinder jacket is disadvantageously formed of relatively thin material, such as chromium foil, for example, which is supported from below only locally and, in this respect, has a polygonal contour. Moreover, in the event of a pointwise or punctiform load, the chromium foil and the appertaining supporting sheetmetal are dented and damaged. This can occur even from one crumpled sheet, for example. In the region of the fastening location, the heretofore known embodiment has no roundness.

SUMMARY OF THE INVENTION

It is accordingly an object of the invention therefore to provide a cylinder of the type referred to at the introduction hereto which is improved with regard to the foregoing disadvantages.

With the foregoing and other objects in view, there is provided, in accordance with the invention, a cylinder of a rotary printing machine having an inner cylinder body, comprising an elastically deformable cylinder jacket formed as part of a circle, the cylinder jacket being substantially intrinsically rigid, and an adjusting device for acting upon the elastically deformable cylinder jacket so as to vary the outer diameter thereof, the adjusting device having a positioning part supported on and radially displaceable relative to the inner cylinder body for shifting the cylinder jacket jointly therewith in the same radial direction, and having a force deflector displaceable over a positioning travel distance derivable from the radial displacement of the cylinder jacket for acting upon the cylinder jacket so as to deform it.

In accordance with another feature of the invention, the force deflector is capable of acting upon end regions of the cylinder jacket so as to deform the cylinder jacket.

In accordance with a further feature of the invention, the cylinder is a sheet-guiding cylinder of the rotary printing machine.

In accordance with an added feature of the invention, the cylinder jacket is secured to the positioning part.

In accordance with an additional feature of the invention, the cylinder jacket has a cross-sectional contour constructed symmetrically to a radially extending plane of symmetry.

In accordance with yet another feature of the invention, the cylinder is secured to the positioning part in the vicinity of the plane of symmetry.

In accordance with yet a further feature of the invention, the cylinder body has a circular-cylindrical cross section.

In accordance with yet an added feature of the invention, the cylinder includes sliding blocks braced against the cylinder body for supporting the positioning part on the cylinder body.

In accordance with yet an additional feature of the invention, the cylinder includes two sliding blocks respectively arranged symmetrically to the plane of symmetry.

In accordance with still another feature of the invention, the force deflector has double levers pivotally supported on the positioning part, a respective first one of the lever arms thereof being cooperable with the cylinder body, and a respective second one of the lever arms thereof being capable of acting upon the cylinder jacket.

In accordance with still a further feature of the invention, the double levers are constructed as bellcranks.

In accordance with still an added feature of the invention, the force deflector is capable of acting upon the cylinder jacket with force.

In accordance with a first alternative feature of the invention, the force deflector is capable of acting upon the cylinder jacket with torque.

In accordance with a second alternative feature of the invention, the force deflector is capable of acting upon the cylinder with force and torque.

In accordance with a concomitant feature of the invention, the cylinder jacket has a cross section which tapers in a direction towards the end regions of the cylinder jacket.

With the construction according to the invention, a cylinder jacket is created which has a substantially intrinsic rigidity, that is, by itself, it has a contour which is approximately part of a circle, yet this contour is not created by any support measures. The intrinsic rigidity is formed so that an adequate dimensional stability exists, yet sufficient elasticity remains for the diameter to be adjusted. This cylinder jacket cooperates with a positioning part which is radially displaceable relative to an inner cylinder body. To that end, the frame part is supported adjustably in the radial direction on the cylinder body. A shifting of the positioning part causes a shifting of the cylinder jacket jointly with the region thereof engaged by the positioning part, the shifting being in the same direction, in fact, in the same radial direction. As a result of this radial shifting, a diameter enlargement or reduction is effected, depending upon the direction, for one region of the cylinder jacket, but the other regions of the cylinder jacket must also be shifted if the diameter adjustment is to be optimized. This is accomplished by an elastic deformation of the cylinder jacket or, in other words, the cylinder jacket is deformed accordingly by a force deflector, the force deflector exerting only forces or only torques, or both torques and forces, on the cylinder jacket in order to establish the desired contour. Because of the intrinsic rigidity of the cylinder jacket, only a few force and/or torque engagement points are necessary, so that the force deflector can be constructed quite simply. This simple construction applies also to an adjusting device, with which the positioning part can be radially shifted relative to the cylinder body. From this radial shifting, a positioning travel is derived which acts upon the force deflector performing the deformation of the cylinder jacket. In particular, the force deflector acts upon the end regions of the cylinder jacket and, indeed, upon the end regions of the contour having a cross section formed as part of a circle.

In a further feature of the invention, the cylinder jacket is secured to the positioning part. Preferably, the cross-sectional contour of the cylinder jacket is constructed symmetrically to a radially extending plane of symmetry. The cylinder jacket is secured to the positioning part preferably in the region of the plane of symmetry, so that the region of the cylinder jacket associated with the plane of symmetry is shifted radially by the positioning part upon actuation of the adjusting device. In contrast therewith, the diameter adjustment in the other regions of the cylinder jacket, spaced apart symmetrically from the plane of symmetry, is effected by the elastic deformation of the cylinder jacket by the force deflector.

In particular, provision is made for the cylinder body to have a circular-cylindrical cross section. For example, it may form the shaft of the cylinder.

The positioning part is preferably supported on the cylinder body by sliding blocks which are supported thereon, and due to which the rectilinear radial motion is made possible. In particular, two sliding blocks, respectively, are present, disposed symmetrically to the plane of symmetry. The word "respectively" used in the preceding sentence indicates that, over the longitudinal extent of the cylinder, several subassemblies of the adjusting device are provided, so that the entire cylinder jacket surface can be adjusted uniformly. In particular, subassemblies or component groups are provided in the end regions of the cylinder. However, it is also possible to provide further subassemblies between the end regions. The subassemblies are either all adjusted uniformly or are adjusted differently, for example, to produce a crowned contour of the cylinder. The construction of concave contours is also possible, in order to produce special printing conditions. In this way, print shrinkage, for example, can be avoided. Hereinafter, in the interest of simplicity, only one subassembly of the cylinder will be discussed, however, as mentioned hereinbefore, a plurality of such subassemblies may be distributed, spaced apart from one another, over the longitudinal extent of the cylinder.

In a further feature of the invention, provision is made for the force deflector to have double levers, which are pivotably supported on the positioning part and, respectively, with a first lever arm thereof, cooperating with the cylinder body and, with a second lever arm thereof, acting upon the cylinder jacket. If a radial shifting of the positioning part relative to the cylinder body occurs, the double levers then pivot or swivel on the cylinder body because of the support of the respective first lever arms thereof. As a result of the pivoting motions of the double levers, action is exerted on the cylinder jacket by the respective second lever arms thereof, namely on the inside of the cylinder jacket, so that an elastic deformation is caused thereby. This action can be effected by forces and/or torques, depending upon what curve course the outer contour of the cylinder is to be given.

The goal is usually a partially circular contour which, as closely as possible, approximates a mathematical partial circle.

The double levers may preferably be constructed as bellcranks, that is, the two lever arms of each double lever form an angle. For an optimal bending contour in the elastic deformation of the cylinder jacket, provision is preferably made for the cross section of the cylinder jacket to taper in the direction of the end regions of the cylinder jacket. By a suitable choice of material and/or the cross-sectional contour, a bending characteristic can be attained in this way which, in cooperation with the force deflector, results in the desired cylinder jacket contour.

Other features which are considered as characteristic for the invention are set forth in the appended claims.

Although the invention is illustrated and described herein as embodied in a rotary printing-machine cylinder having a variable outer diameter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENT

Figure 1:
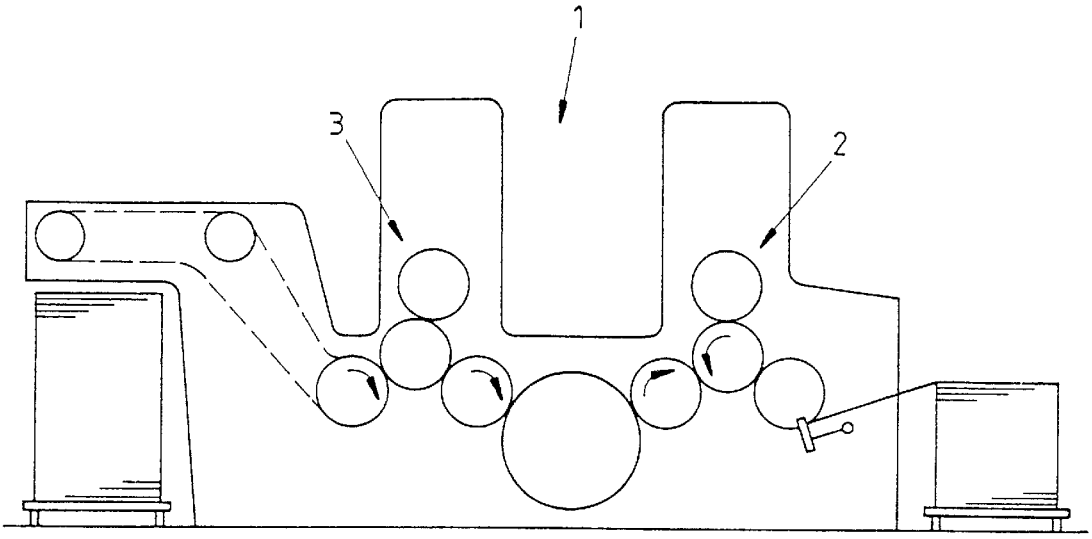
FIG. 1 is a diagrammatic side elevational view of a rotary printing machine.

Referring now to the drawings and, first, particularly to FIG. 1 thereof, there is shown therein a diagrammatic side elevational view of a rotary printing machine 1 having two printing units 2 and 3. The printing units 2 and 3 have many cylinders, which perform various tasks; at least some of the cylinders form sheet guiding drums which transport sheets to be printed. To adapt to types of paper of various thickness, the outer diameter of certain of the cylinders is variable.

Figure 2:
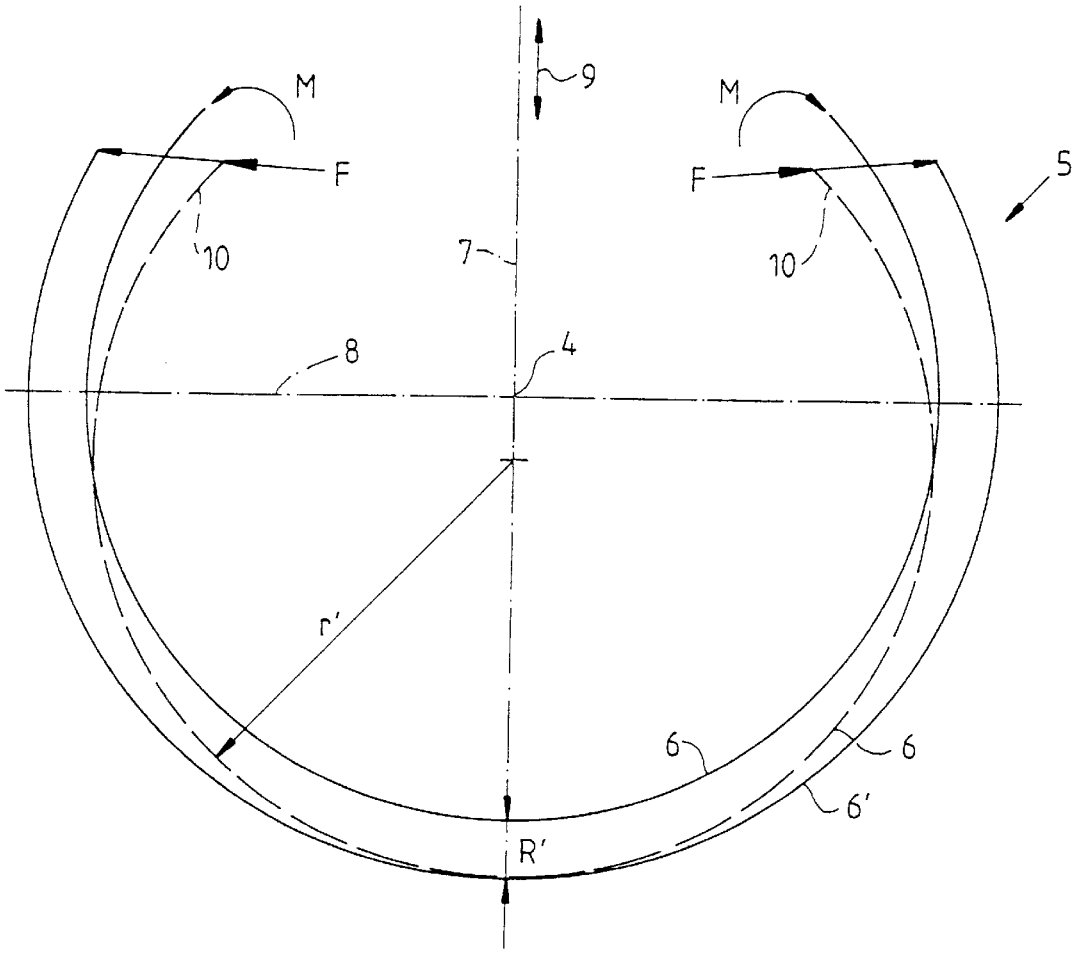
FIG. 2 is a basic diagrammatic sketch of a rotary printing-machine cylinder having a variable outer diameter.

FIG. 2 illustrates the principle of a cylinder 5 having an adjustable outer diameter. Reference numeral 4 indicates the rotational axis of the cylinder 5 which has a cylinder jacket 6 constructed in the form of a partial circle. A symmetrical construction of the contour of the cylinder jacket 6 is provided with respect to a plane of symmetry 7 which passes through the rotary axis 4. A plane of symmetry 8, which likewise passes through the rotary axis 4, extends perpendicular to the plane of symmetry 7.

By the action of an adjusting device, represented by a double arrow 9, but not otherwise shown in detail in FIG. 2, the cylinder jacket 6 can be displaced radially (radial displacement R') along the plane of symmetry 7, so that the location of the cylinder jacket 6, represented by a broken line, is set. However, this position is merely imaginary because, simultaneously with the radial shifting, a widening of the cylinder jacket 6 takes place; in other words, it is elastically deformed. In accordance with a first exemplary embodiment of the invention, this can be effected by a force F which engages the end regions 10 of the cylinder jacket 6. In a further exemplary embodiment, it is also conceivable for a moment M to engage the respective end region 10, resulting in the position of the cylinder jacket indicated by 6' in FIG. 2. It will be appreciated that, in this position 6', an enlarged outer diameter is involved.

Figure 3:
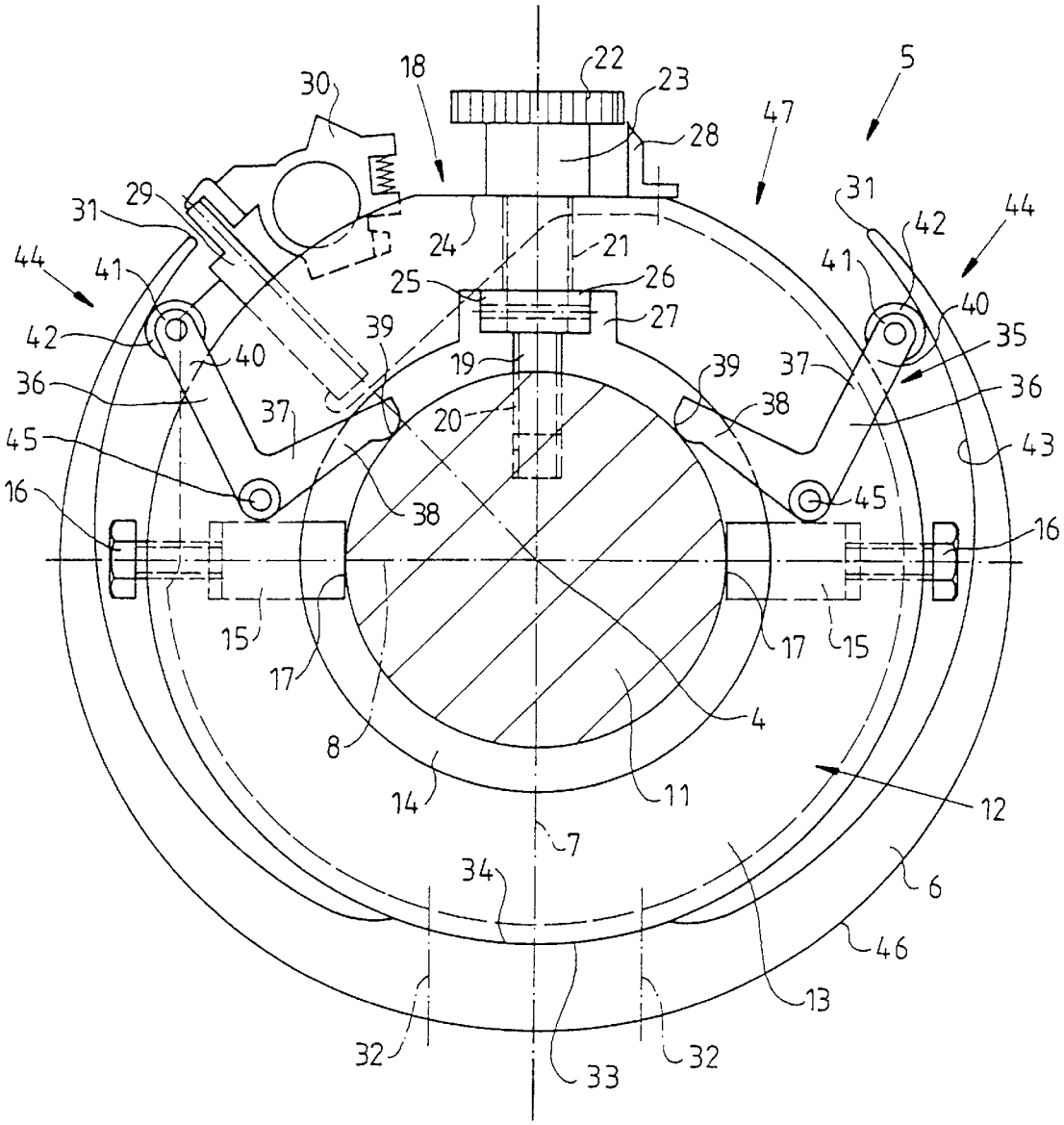
FIG. 3 is an exemplary end view of an embodiment of the rotary printing-press cylinder according to the invention set in a "minimum diameter" position.

FIG. 3 shows an exemplary embodiment of the cylinder 5 in accordance with the functional principle of FIG. 2. The cylinder 5 has an inner cylinder body 11, which is rotatably supported or journalled in a locally fixed position in the rotary printing machine by non-illustrated bearings. The cylinder body 11 has a circular cross section. A positioning or adjusting part 12 is constructed in the form of a setting ring 13, which is formed with an internal bore 14 having a larger diameter than that of the cylinder body 11. Two sliding blocks 15 are disposed on the setting ring 13; the sliding blocks 15 are located on either side of the plane of symmetry 7 and can be adjusted in the spacing thereof with respect to one another radially by threaded screws 16. Front end faces 17 of the two sliding blocks 15 receive the cylinder body 11 therebetween with little play; central axes of the sliding blocks 15 and the threaded screws 16 lie in the plane of symmetry 8. In this way, the setting ring 13 is supported radially displaceably on the cylinder body 11; specifically, radial shifting is possible both in the direction of the plane of symmetry 7 and perpendicularly to the rotational axis 4.

The radial displacement of the setting ring 13 relative to the cylinder body 11 is possible by a setting device 18 having a threaded spindle 19 which is screwed into a threaded bore 20 formed in the cylinder body 11. The threaded spindle 19 and the threaded bore 20 lie in the plane of symmetry 7 and extend at a right angle to the rotational axis 4. The threaded spindle 19 passes through a radial bore 21 formed in the setting ring 13 and, at an end thereof, has a setting knob 23 provided with a scale 22.

The setting knob 23 has a larger diameter than that of the radial bore 21 and hence can be supported on a support face 24 formed on the setting ring 13. A slide ring 25 is pinned to the threaded spindle 19 and is located, with slight play, opposite a support face 26 defining a recess 27 formed in the setting ring 13, the recess 27 being open at the periphery of the inner bore 14. In this way, by rotating the setting knob 23, the relative position between the setting ring 13 and the cylinder body 11 can be adjusted in the radial direction. The adjusted value can be read from the scale 22 by a pointer 28.

A gripper bearing strip 29 and a gripper system 30 are secured to the cylinder body 11. The cylinder jacket 6 of the cylinder 5 has a partly circular construction; that is, between ends 31 thereof, a gap extending over a circumferential angle of the cylinder jacket 5, which thus forms only part of a circle, remains, wherein the setting knob 23, the gripper bearing strip 29 and the gripper system 30 are all located. In the region of the plane of symmetry 7, the cylinder jacket 6 is secured to the setting ring 13 by fastening screws 32. In this region, the cylinder jacket 6 is formed with a support face 33, which is fastened by the fastening screws 32 to an outer periphery 34 of the setting ring 13. A force deflector 35 is disposed on the setting ring 13. The force deflector has two double levers 36, which are formed as bellcranks 37. Each bell crank 37 has a first lever arm 38 with a crowned end region 39 cooperating with the jacket face or outer cylindrical surface of the cylinder body 11 or, in other words, is braced against it. The second lever arm 40 of the bellcrank 37, which extends at an angle of between 0° and 180°, preferably 90°, to the first lever arm 38, carries a roller 42 at an end region 41 thereof, and this roller 42 is braced against an inner jacket face 43 of the cylinder jacket 6, in the respective end region 44 of the cylinder jacket 6. The respective bellcrank 37 is pivotally supported at the elbow region thereof on the setting ring 13 by a bolt 45; this bearing point is preferably located above the plane of symmetry 8 or, in other words, on the side of the setting ring 13 at which the setting device 18 is located.

In the region of the plane of symmetry 7, the cylinder jacket 6 is provided with the greatest wall thickness thereof. Beginning at the support face 33, the wall thickness decreases, symmetrically to the plane of symmetry 7, towards the ends 31 of the cylinder jacket 6, the outer jacket face 46 of the cylinder jacket 6 having the form of part of a circle, and the inner jacket face 43, in this regard, having a course which results in a cross-sectional tapering towards the respective ends 31. The cylinder jacket 6 is manufactured with a minimum radius, consequently, in order to provide the cylinder jacket 6 with a larger diameter, it must be widened by an adjusting device 47. Belonging to this adjusting device 47 are the setting device 18, the positioning part 12, and the force deflector 35, among other elements. It is possible, in the same way, for the cylinder jacket 6 to be manufactured with a maximum radius and, in order to provide the cylinder jacket with a smaller diameter, the cylinder jacket 6 is caused to be contracted by a suitable non-illustrated adjusting device.

If the diameter and the radius r, respectively, of the cylinder 5 is to be increased, in order to adapt to the thickness of the material or stock to be printed, for example, by being adjusted to the maximum radius R. this is effected by turning the setting knob 23. Whereas in FIG. 3 the minimum diameter of the cylinder 5 is shown, the largest possible diameter of this cylinder 5 can be seen from FIG. 4. By the aforementioned turning of the setting knob 23, the threaded spindle 19 is screwed more deeply into the threaded bore 20 and, accordingly, the setting ring 13 is displaced over a radial course, namely in the plane of symmetry 7 relative to the cylinder body 11. The result thereof is that the outermost point 48 shifts downwardly by a given amount, for example, the amount $R^1$ in FIG. 4, so that, beginning at the rotary axis 4, the radius R is set. Simultaneously with the radial displacement motion, the two bellcranks 37 pivot about the bolts 45 thereof, because they are supported by the end regions 39 thereof on the jacket face of the cylinder body 11 and, as a result of the aforementioned shifting motion, the bearing points thereof, namely the bolts 45, move downwardly, so that the bellcrank 37 located on the left-hand side of the plane of symmetry 7 executes a counterclockwise pivoting motion, while the bellcrank 37 located on the right- of the plane of symmetry 7 executes a clockwise pivoting motion. Because of the symmetrical conditions, the two pivot angles of the bellcranks 37 are of equal size. Due to the pivoting motions, the rollers 42 press the respective end regions 44 of the cylinder jacket 6 outwardly and, based upon the choice of the cross-sectional configuration of the cylinder jacket, the materials chosen, and so forth, an elastic deformation occurs, so that the outer jacket face 46 of the cylinder jacket 6 continues as much as possible to have the form of part of a circle. It is possible to keep the deviation from a mathematical partial circle within very narrow limits. For example, in the region around the outermost point 48, it is possible to attain a diameter difference of $\leqq 0.04$ and a roundness of from 0.07 to 0.1. Because of the linear radial adjustment according to the invention by the setting device 18, it is thus possible to act upon the entire cylinder jacket 6, which has only a few support points, each of which exerts a force upon the cylinder jacket 6 for effecting an adjustment of the diameter. The cylinder jacket 6 is of intrinsically rigid construction, that is, it requires only the few support points mentioned and nevertheless has adequate mechanical strength, and above all has the properties which are optimal for shaping (the partial-circular form). Preferably, a linear adjustment is realized, that is, a corresponding diameter widening results, and the radial adjustment distance and the diameter widening have a constant ratio over the entire adjustment range.

Figure 4:
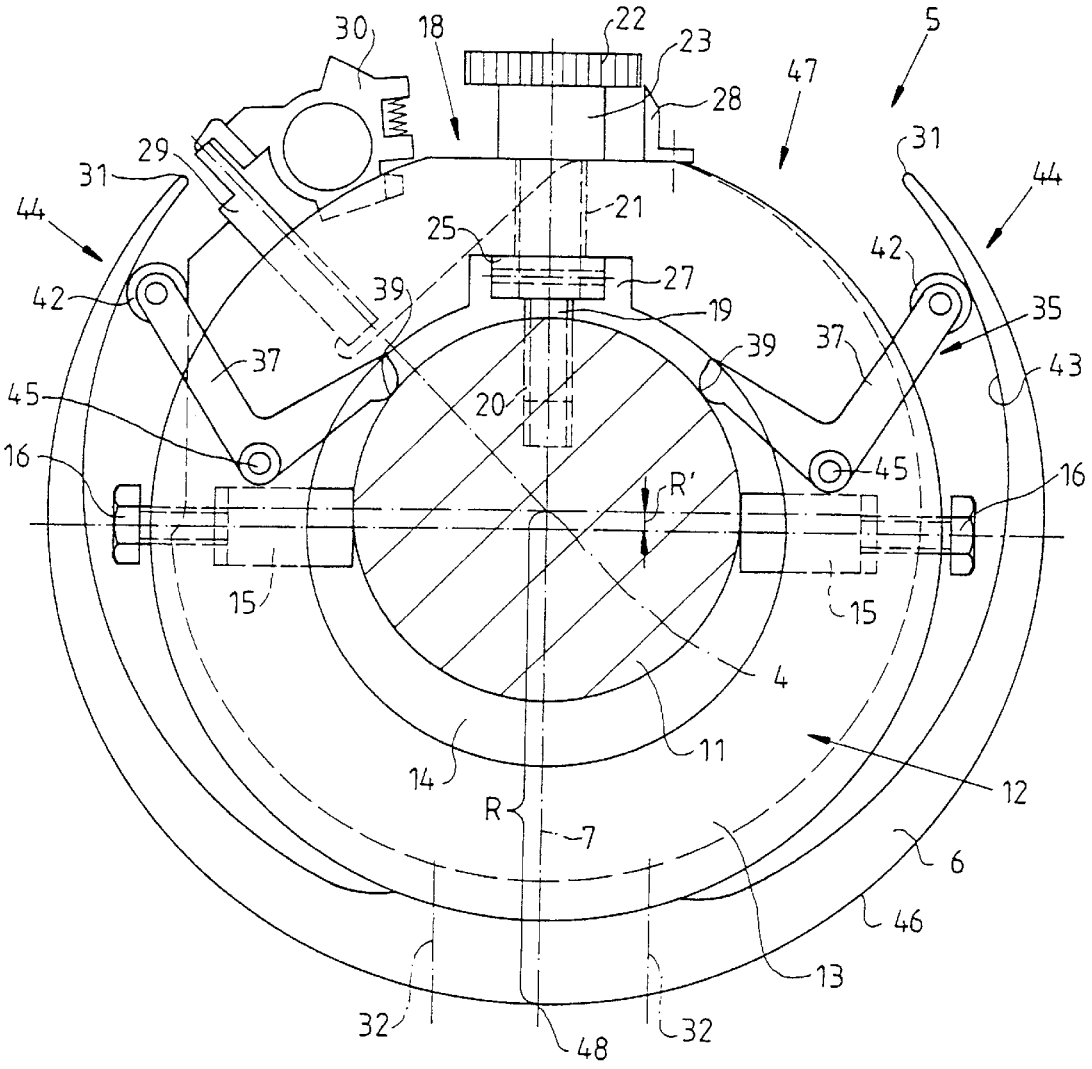
FIG. 4 is a view corresponding to that of FIG. 3, but showing the cylinder set in a "maximum diameter" position.

If a smaller diameter of the cylinder 5 is to be set again, beginning at the setting or position illustrated in FIG. 4, the setting head 23 is then turned in the opposite direction and, consequently, the slide ring 24, in the position shown in FIG. 4, raises the setting ring 13 relative to the cylinder body 11. This causes the outermost point 48 to "migrate upwardly", on the one hand, and causes as well corresponding pivoting motions of the two bellcranks 37.

Figure 5:
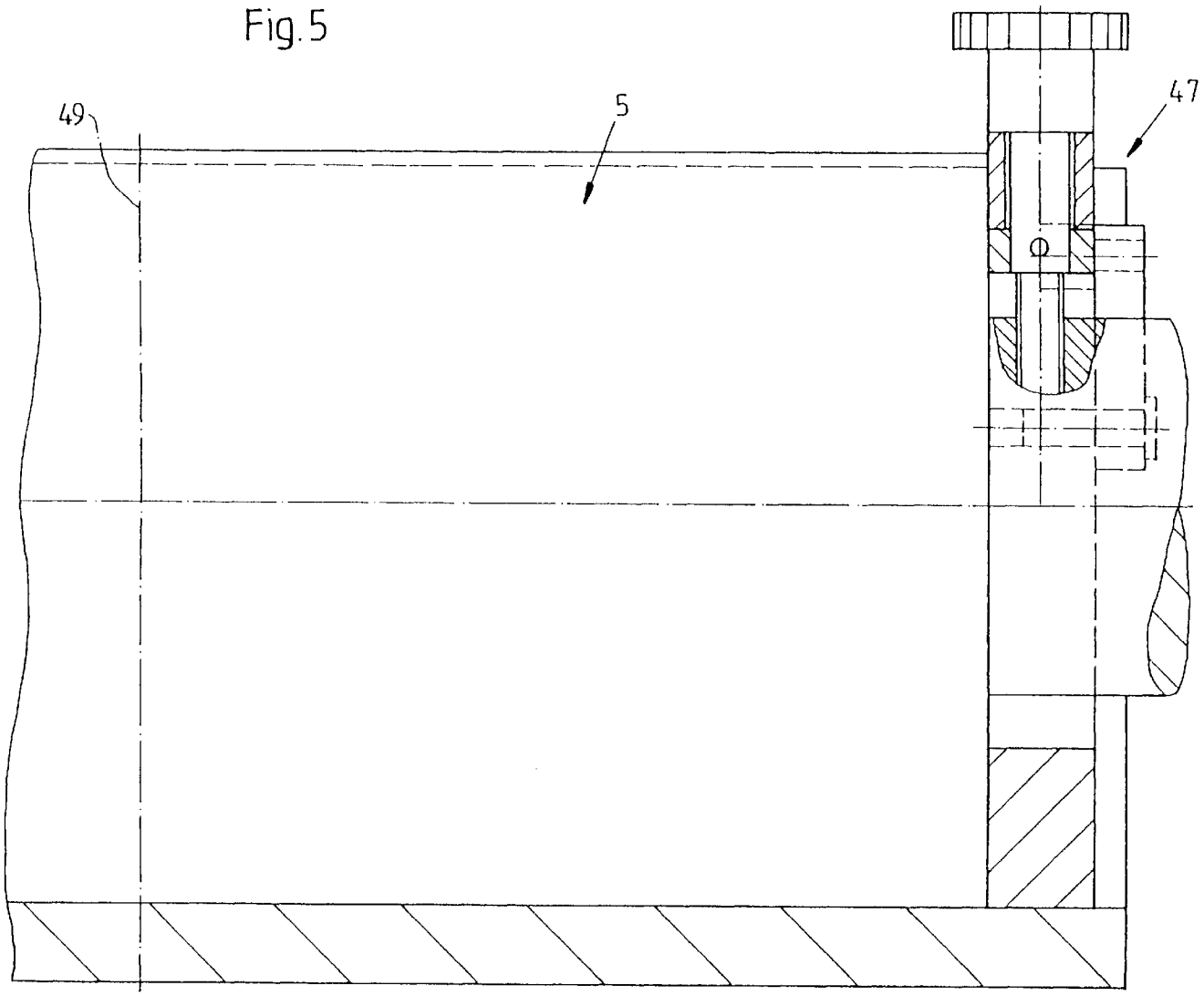
FIG. 5 is a side elevational view, partly in section and partly broken away, of FIG. 3.

FIG. 5 is a side view of the embodiment of FIGS. 3 and 4, from which it is clear that the adjusting device 47 is located on the end face of the cylinder 5. FIG. 5 also shows a center line 49 of the cylinder 5. The center line 49 also forms the center line of the rotary printing machine. Another adjusting device 47 is likewise located on the non-illustrated other side of the cylinder 5 towards the left-hand side from the center line 49.

Figure 6:
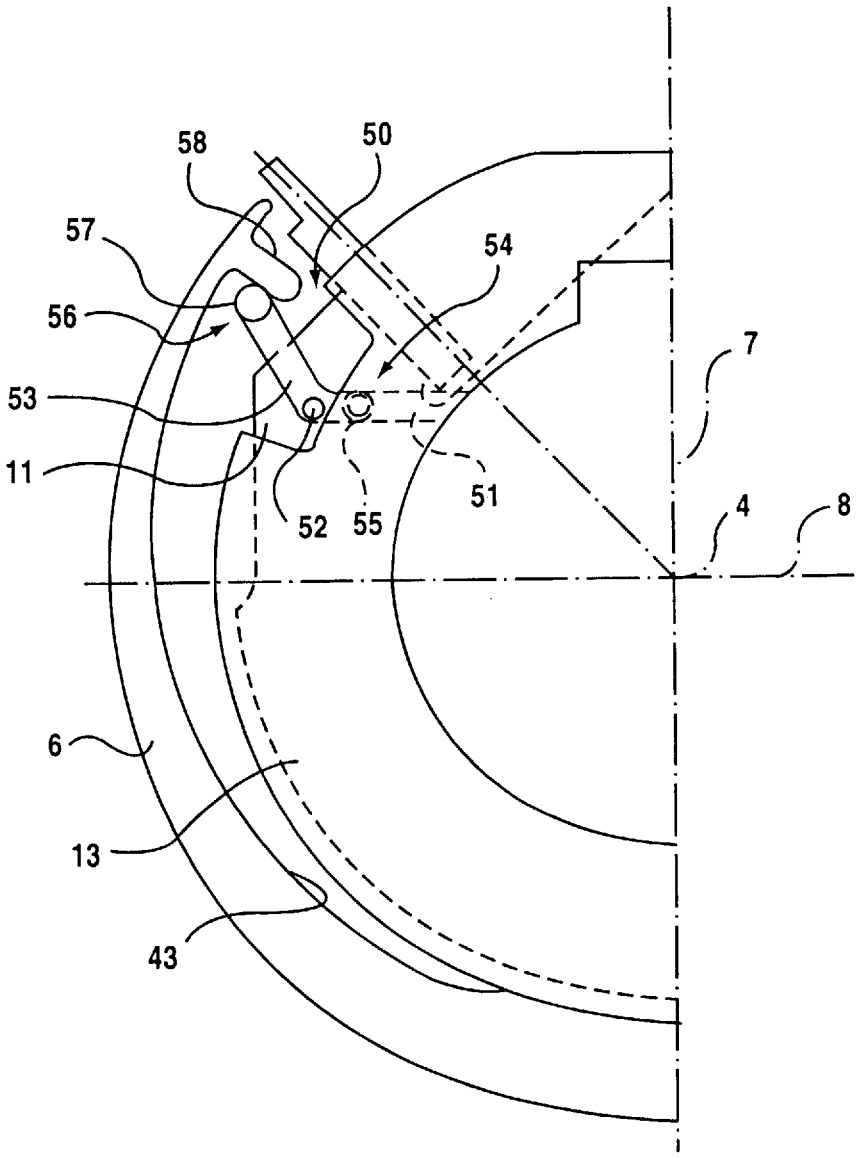
FIG. 6 is a fragmentary view, like that of the left-hand half of FIG. 3, of another exemplary embodiment of the cylinder according to the invention.

FIG. 6 shows diagrammatically a further exemplary embodiment of the invention wherein, in the interest of simplicity, only the differences from the exemplary embodiment of the preceding figures will be explained. The cylinder body 11, in the exemplary embodiment of FIG. 6, has a relatively large diameter which is nearly as large as the outer diameter of the setting ring 13. In this regard, the two parts are disposed behind one another, as viewed in the longitudinal direction of the pivot axis 4. The setting ring 13 has a recess 50 open at the periphery in each of the two upper quadrants of the arrangement formed by the planes of symmetry 7 and 8, a control groove 51 of the setting ring 13 terminating in the peripherally open recess 50. By employing a bolt 52, a toggle lever 53 is pivotally supported on the cylinder body 11; in one end region 54, this toggle lever 53 carries a roller 55 which engages in the control groove 51 and, in the other end region 56, is formed with a crowned bearing face 57, which is braced against a protrusion 58 of the cylinder jacket 6. The protrusion 58 begins at the inner jacket face 43 of the cylinder jacket 6 and extends in the radial direction.

If a radial shifting of the setting ring 13 relative to the cylinder body 11 is effected by the setting device 18, which is not illustrated in FIG. 6 then, by the engagement of the roller 55 in the control groove 51, the bellcrank 53 is pivoted about the bolt 52, causing the end region 56 to act upon the approximately radially extending outer face of the protrusion 58 in such a way that, in accordance with the view of FIG. 2, a moment M is transmitted, that is, in FIGS. 3 and 4, action is exerted upon the cylinder jacket 6 by forces, whereas in the exemplary embodiment of FIG. 6 there is no application of force but rather an application of a moment, which results in a different bending line of the cylinder jacket 6. With the construction according to the invention, all the necessary surfaces of the cylinder 5 can be generated, for example, by securing chromium foil, Super Blue, glass bead cloth and so forth to the cylinder jacket 6 with suitable clamping and tensioning devices. As an alternative to the embodiments shown in the drawings, it is also possible to form the cylinder shape by a plurality of segments, that is, the cylinder jacket 6 is then not constructed in one piece but in multiple pieces, with one region in each case secured and another region deformed elastically by a force deflector. If relatively large diameters are to be attained, then it is also possible to provide more than two levers per adjusting device 47. The invention also allows for the creation of cylinder surfaces which deviate from the ideal circular form, examples being crowned cylinder surfaces. This is possible because other positioning mechanisms are provided in the axial direction of the cylinder 5 or, in other words, not only in the end regions. Preferably, a plurality of adjusting devices may be coupled together by suitable gears, so that, simultaneously, an automatic setting of all the positioning mechanisms is effected. To make the cylinder jacket 6 rigid, for example, in order to avoid undesirable sagging parallel to the rotary axis 4, reinforcing ribs may be disposed on the inner jacket face 43.

For deforming the cylinder jacket 6, it is also possible to contemplate using eccentric elements or corresponding gears which accomplish the same or a similar deformation, instead of the bellcranks and rollers described hereinbefore.

I claim:

1. A cylinder of a rotary printing machine having an inner cylinder body, comprising an elastically deformable cylinder jacket having a cross section formed as part of a circle, said cylinder jacket being substantially intrinsically rigid, and an adjusting device for acting upon said elastically deformable cylinder jacket so as to vary the outer diameter thereof, said adjusting device having a positioning part supported on and radially displaceable relative to the inner cylinder body for shifting said cylinder jacket jointly therewith in the same radial direction, and having a force deflector displaceable over a positioning travel distance derivable from the radial displacement of said cylinder jacket for acting upon said cylinder jacket so as to deform it.

2. The cylinder according to claim 1, wherein said force deflector is capable of acting upon end regions of said cylinder jacket so as to deform said cylinder jacket.

3. The cylinder according to claim 1, wherein the cylinder is a sheet-guiding cylinder of the rotary printing machine.

4. The cylinder according to claim 1, wherein said cylinder jacket is secured to said positioning part.

5. The cylinder according to claim 1, wherein said cylinder jacket has a cross-sectional contour constructed symmetrically to a radially extending plane of symmetry.

6. The cylinder according to claim 5, wherein said cylinder is secured to said positioning part in the vicinity of the plane of symmetry.

7. The cylinder according to claim 1, wherein said cylinder body has a circular-cylindrical cross section.

8. The cylinder according to claim 1, including sliding blocks braced against said cylinder body for supporting said positioning part on said cylinder body.

9. The cylinder according to claim 5, including two sliding blocks respectively arranged symmetrically to the plane of symmetry.

10. The cylinder according to claim 1, wherein said force deflector has double levers pivotally supported on said positioning part, a respective first one of the lever arms thereof being cooperable with said cylinder body, and a respective second one of the lever arms thereof being capable of acting upon said cylinder jacket.

11. The cylinder according to claim 10, wherein said double levers are constructed as bellcranks.

12. The cylinder according to claim 1, wherein said force deflector has double levers pivotably supported on said positioning part, each double lever being supported with an end region of a respective first lever arm on said cylinder body and with an end region of a respective second lever arm on an inner jacket face of said cylinder jacket and acting upon said inner jacket face of said cylinder jacket with force.

13. The cylinder according to claim 1, which further comprises double levers pivotably supported on said cylinder body, each double lever gripping with an end region of a respective first lever arm into a respective control groove formed in said positioning part and being supported with an end region of a second lever arm on a protrusion of said cylinder jacket, said double levers acting upon said cylinder jacket with torque.

14. The cylinder according to claim 1, wherein said cylinder jacket has a cross section which tapers in a direction towards said end regions of said cylinder jacket.

15. Method for adjusting an outer diameter of a sheet guiding cylinder in a rotary printing machine, the method which comprises:

providing a sheet guiding cylinder having a cylinder body and a substantially intrinsically rigid, elastically deformable cylinder jacket being radially displaceable relative to the cylinder body and having a cross section formed as a part of a circle;

displacing the cylinder jacket relative to the cylinder body in a radial direction by a predetermined displacement distance; and deforming the cylinder jacket at end regions thereof such that a diameter of an outer face of the cylinder jacket is changed and the cross-section remains essentially formed as a part of a circle.

16. The method according to claim 15, wherein the displacing step comprises displacing the cylinder jacket in a radial direction along a symmetrical plane which extends through an axis of rotation of the cylinder body.

17. The method according to claim 15, which further comprises, simultaneously with the displacing step, deforming the cylinder jacket.

18. The method according to claim 15, which comprises: displacing and deforming the cylinder jacket with a ratio of the displacement distance and the change in diameter being constant over an entire adjustment range.

19. The method according to claim 15, wherein the deforming step comprises deforming the cylinder jacket at the end regions by a force acting on the end regions.

20. The method according to claim 15, wherein the deforming step comprises deforming the cylinder jacket at the end regions by a torque acting on the end regions.

* * * * *